United States Patent [19]

Hsu

[11] 4,251,959

[45] Feb. 24, 1981

[54] AMPHIBIOUS SAFE TENT

[76] Inventor: Yun T. Hsu, 30-27, Chun In Rd., Chun In Village, Tong Sun Hsiang, I Lan Hsien, Taiwan

[21] Appl. No.: 7,822

[22] Filed: Jan. 30, 1979

[51] Int. Cl.[3] ..... E04B 1/34

[52] U.S. Cl. ..... 52/2; 9/11 A

[58] Field of Search ..... 52/2; 9/11 A

[56] References Cited

U.S. PATENT DOCUMENTS

| | | | |
|---|---|---|---|
| 2,854,014 | 9/1958 | Hasselquist | 52/2 |
| 2,859,457 | 11/1958 | Manhart | 52/2 X |
| 2,875,771 | 3/1959 | Brewin | 52/2 |
| 2,908,919 | 10/1959 | Bickwell et al. | 52/2 X |
| 2,959,278 | 11/1960 | Mitchell et al. | 52/2 X |
| 3,058,127 | 10/1962 | Hassold | 52/2 X |
| 3,092,854 | 6/1963 | Manhart | 52/2 X |
| 3,130,406 | 4/1964 | Jones-Hinton et al. | 52/2 X |
| 3,145,719 | 8/1964 | Johnson | 52/2 |
| 4,000,749 | 1/1977 | Busco | 52/2 X |
| 4,068,418 | 1/1978 | Masse | 52/2 |

*Primary Examiner*—Carl D. Friedman

*Attorney, Agent, or Firm*—Cushman, Darby & Cushman

[57] ABSTRACT

A structural design of a tent for camping, particularly an inflatable amphibious tent which consists of a tent case, a guard tent and an air mattress connected with the internal base of the tent case. The tent case and air mattress each have a few valve holes for rapid inflation so that the tent can be erected on the land or on the water, and it is not necessary to construct supports. Since the base is an air mattress, the tent when used on land can be free of the discomfort resulting from accumulated water on rainy days and of the trouble of digging a ditch. The interior of the surface layer inner and outer annular edges of the upper annular surface and the outer annular edge of the lower annular surface of the air mattress respectively, wrap a cord or bead chain which winds about and crosses the air column of tent case so as to make structure of the tent case as a whole very firm, and to keep same balanced and stable while floating on the water. Therefore, this tent for camping will never become distorted or deformed.

4 Claims, 4 Drawing Figures

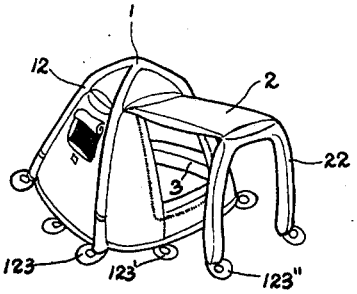
Fig. 3
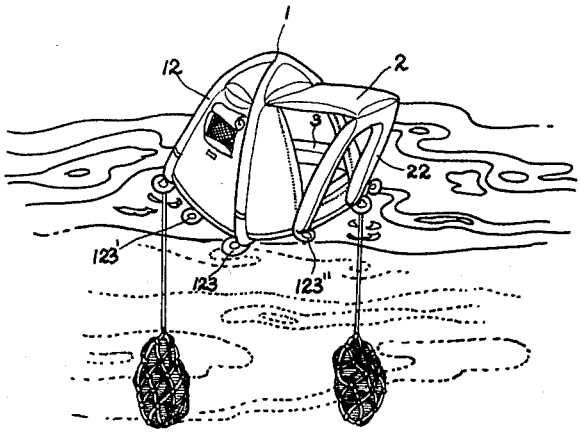
Fig. 4
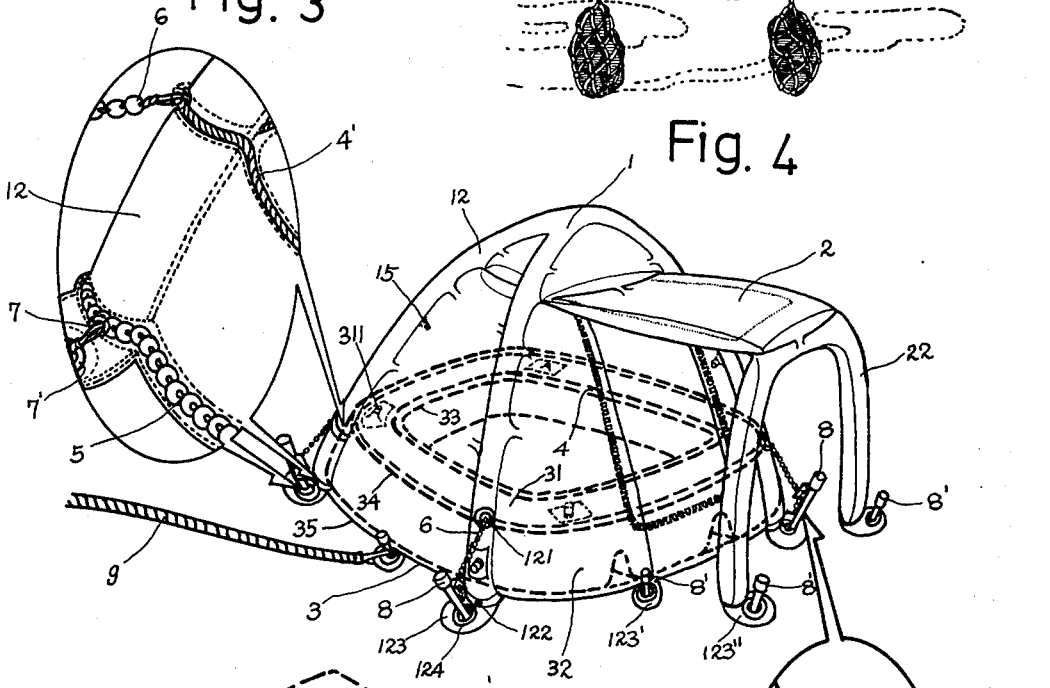
Fig. 1
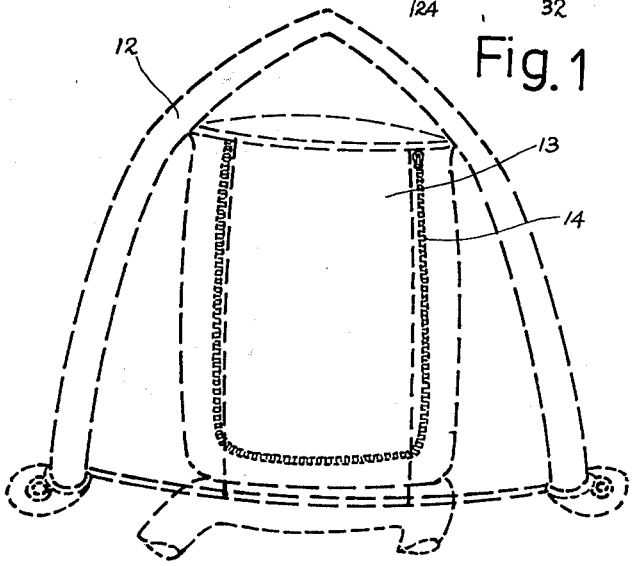
Fig. 2
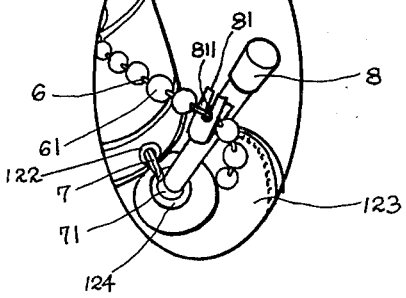

AMPHIBIOUS SAFE TENT

BACKGROUND OF THE INVENTION

It is well-known that the conventional tent for camping is limited to use on the land and has no other purpose. While being erected on the land, it is inevitably troublesome and time-consuming to dig a ditch around the tent so as to prevent water from accumulating. While camping in a mountain area, in case of an accidental flood, the tent as a whole will be inevitably washed away by the terrible swift currents of the flood and a serious accident will happen. In view of these drawbacks of conventional tents, it is highly desirable to improve the tent for camping.

SUMMARY OF THE INVENTION

This invention is aimed at providing a safe amphibious tent which can be quickly and easily erected. It is an air inflatable structure and can be rapidly erected on the land by means of air inflation only. It is not necessary to erect the supports. The base of tent is an air mattress which will not accumulate water on rainy days. The tent design also eliminates the requirement of digging a ditch, and is specially designed with a cord and bead chain wrapped in the air mattress so as to make the structure of tent as a whole very firm. In case of a mountain flood, it can safely float on the water so as to protect the security of people and their articles. The tent base includes a ring which may be hooked by one end of a long rope. The other end of the rope may be fixed to a tree or big stone nearby the tent, so as to avoid the danger of the tent being washed away by the flood. In addition to being used on the land, this invention can be used on water in a river or lake while camping, so as to remarkably enrich the experience of outdoor life in the wilds.

BRIEF DESCRIPTION OF THE DRAWING

FIG. 1 is a relief view of this invention amphibious safe tent;

FIG. 2 is a front view of the tent case of the amphibious tent of the present invention;

FIG. 3 is a sketch of the amphibious tent of the present invention erected on the land; and FIG. 4 is a sketch of safe amphibious tent of the present invention floating on the water.

DESCRIPTION OF THE PREFERRED EMBODIMENT

In reference to the drawings, this invention is best described in detail as follows:

As shown in FIG. 1, the tent case (1) is connected a guard tent (2). The internal base of tent case (1) is connected to an air mattress (3). There are a few valves (311) on the upper annular surface (31) of air mattress (3). A cord (4) is wrapped at the interior surface layer of inner annular edge (33) of the upper annular surface (31). At the interior surface layer of outer annular edge (34) of upper annular surface (31) and at the interior surface layer of outer annular edge (35) of the lower annular surface (i.e. the interior surface layer of the top annular edge (34) and bottom annular edge (35) of outer annular surface (32) where the air mattress (3) and tent case (1) connect each other) of air mattress (3), there are respectively wrapped a cord (4') and a bead chain (5) which also wind and cross the interior surface layer of air columns (12) around the tent case (1). Since the said cord (4') and bead chain (5) surround the tent, the structure of tent as a whole is firmly bonded, has a tension while floating on the water, and will neither lose its balance nor lead to distortion of the tent base even when the water is very rough.

Each air column (12) of the tent case (1) also has air-valves (15); thus when the air column is filled with air, the tent case (3) is erected. There are two metal ring holes (121) (122) on each air column (12). The upper ring hole (121) is set at the intersection of the air column (12) and the cord (4'), and a small bead chain (6) is hooked by the cord (4') from the upper ring hole (121). The lower ring hole (122) is set at the intersection of the air column (12) and the bead chain (5) therein, and a small cord (7) is hooked by the bead chain (5) from the lower ring hole (122). The said small cord (7) is connected with a ring case (71) and the length of this small cord (7) just reaches the ring case (71) to be set in the ear ring (123) which connects to the base of the air column (12).

A metal ring hole (124) in the center of the ear ring (123) at the base of air column (12) can be fixed on the ground by a metal peg (8) which includes a metal plate (81) fixed to the side of the peg having a catch hole (811) which can catch the small bead chain (6). After we inflate the tent case (1) and air mattress (3) at its base and erect the tent on the land, the metal peg (8) is inserted through the ring case (71), which is hooked by the lower metal ring hole (122) at the base of each air column (12), and through the ear ring (123) of air column (12). The said peg (8) is thus fixed on the ground by means of a hammer. In the meantime, the small bean chain (6) hooked by the upper metal ring hole (121) of each air column (12) is tightly pulled to catch the chain bead in the catch hole (811) of the metal plate (81) on the metal peg (8). Fixing each air column (12) of the tent is then finished. An ear ring (123) set at the base of each air column and a few ear rings (123') set around the base of tent case (1) can be crossed and fixed on the ground by wooden (or metal) pegs (8') so as to enhance the solidity of the tent. At the same time, the said ear rings (123') can be looped by one end of the long rope (9) and another end thereof can be firmly tied to a fixed object such as tree or big stone so as to prevent the tent from being washed away by the rapid currents of a mountain flood or the like.

A tent door (13) set on one side of the tent case (1), namely that side between two air columns (12), may be opened by means of a zipper (14) as shown in FIG. 2. The tent case (1) is connected with a guard tent (2) at the upper edge of tent door (13). The said guard tent (2), also with two air columns (22) and an ear ring (123'') set at the base of each of these two air columns (22), can be crossed and fixed on the ground by means of wooden (or metal) pegs (8'). If the tent is floating on the water, these two air columns (22) of guard tent (2) can be bent and set at the base of tent case (1), and the base ear ring (123'') of air column (22) and the base ear ring (123') of tent case (1) can be bound together. If the tent is to be anchored but still floating on the water, a heavy object such as a stone can be tied at each ear ring (123') so as to anchor the tent as shown in FIG. 4.

Since the tent case (1) and guard tent (2) are connected and air-filled together, each air column (12) (22) will erect upon inflation, and no support is needed. However, the tent case (1) and guard tent (2) are not air-filled together with the air mattress (3) at the base so as to avoid the floating tent as a whole from sinking into the water in case of an air leak in one of them.

I claim:

1. An amphibious tent for use on land or in water comprising:

(1) an inflatable annular base;

(2) said annular base having an annular top and an annular bottom surface and an annular outer side surface connecting said annular top and bottom surfaces, said top surface having inner and outer annular top edges, said bottom surface having an annular outer bottom edge;

(3) a flexible tent wall having an outer perimeter, said tent wall being fixed to said base at said annular outer side surface, said tent wall including a plurality of inflatable columns, each having first and second ends, whose interiors are in mutual communication at said first ends and whose exteriors are connected to said annular base at their bottom ends, such that said plurality of inflatable columns are caused to extend upward when said base is horizontally disposed and said columns and said base are inflated, so that said tent stands erect, said base and said tent wall defining an enclosed space;

(4) means for preventing communication between the interiors of said inflatable columns and the interior of said annular base;

(5) first, second and third inelastic elongated flexible members respectively fixed to and surrounding said base along said annular inner and outer top edges and said annular outer bottom edge, except at said columns, so that the annular shape of said base is retained when said base is inflated and subjected to external stressed, said second and third inelastic flexible members curving outward from said edges at said inflatable columns to surround said plurality of inflatable columns; and (6) a plurality of means, each connected to said second and third inelastic flexible members at a corresponding one of said plurality of inflatable columns, for fastening the tent to the ground when said tent is used on land.

2. An amphibious tent as in claim 1 wherein said each of said fastening means comprises:

a loop flexibly connected to said third inelastic flexible member at said corresponding one of said plurality of inflatable columns;

a bead chain having a plurality of adjacent beads and having a first end connected to said second elongated inelastic flexible member at said corresponding one of said plurality of inflatable columns, and a second end; and a stake, insertable into the ground through said loop, for fastening of said tent to the ground, said stake including means for fastening said stake to said chain between any two of said plurality of adjacent beads so as to tighten said fastening of said tent to the ground.

3. An amphibious tent as in claim 2 wherein said plurality of inflatable columns include four symmetrically spaced first inflatable columns, said tent wall having a zipper opening door formed between two of said four columns;

said inflatable tent further comprising two second inflatable columns connected to said door so as to support said door horizontally as a canopy when said two second inflatable columns are inflated.

4. An amphibious tent as in claim 3 wherein said four first and two second inflatable columns all communicate with each other internally so that all of said four first and two second inflatable columns may be inflated by inserting air into any one of four first and two second inflatable columns;

said amphibious tent further comprising means for fastening said two second inflatable columns to the ground when said tent is used on land and to said inflatable annular base when said tent is used on water.

* * * * *